US005735588A

United States Patent [19]

Dittman et al.

[11] Patent Number: 5,735,588

[45] Date of Patent: Apr. 7, 1998

[54] PREPARATION DEVICE FOR HOT-MELT ADHESIVES

[75] Inventors: Ralf Dittman, Melbeck; Matthias Bahr, Luneburg, both of Germany

[73] Assignee: Nordson Corporation, Westlake, Ohio

[21] Appl. No.: 727,995

[22] Filed: Oct. 10, 1996

[30] Foreign Application Priority Data

Oct. 11, 1995 [DE] Germany ..... 29516126 U

[51] Int. Cl.[6] ..... A47B 88/00

[52] U.S. Cl. ..... 312/330.1; 312/237

[58] Field of Search ..... 312/330.1, 249.8, 312/249.1, 201, 223.1

[56] References Cited

U.S. PATENT DOCUMENTS

| | | | |
|---|---|---|---|
| 1,774 | 9/1840 | Seltzer | 312/201 |
| 4,308,447 | 12/1981 | Nötzold et al. . | |
| 4,784,446 | 11/1988 | Newhouse | 312/249.8 |
| 5,399,007 | 3/1995 | Marconet | 312/249.8 |

FOREIGN PATENT DOCUMENTS 0225635 6/1987 European Pat. Off. .

*Primary Examiner*—Peter M. Cuomo

*Assistant Examiner*—Gerald A. Anderson

*Attorney, Agent, or Firm*—Wood, Herron & Evans L.L.P.

[57] ABSTRACT

A preparation device (10) for hot melt adhesives includes a base (20) which supports operational components (30, 40) within a housing (50), the operational components (30, 40) including a supply tank (30), a heater (32), a pump (34), a valve (36), an electric motor 38, a control unit (40), and couplings therebetween. The housing (50) includes a stationary section (52) and a movable section (54), both supported on the base (20). The movable section (54) moves horizontally from a closed housing position to an open housing position, thereby facilitating access to one or more of the operational components (30, 40) for periodic tasks such as repair, maintenance or cleaning. This overall structure for the preparation device (10) provides improved access to operational components (30, 40), and it also allows the operational components (30, 40) to be arranged closer together, thereby achieving another desirable feature of compactness in design.

9 Claims, 2 Drawing Sheets

PREPARATION DEVICE FOR HOT-MELT ADHESIVES

FIELD OF THE INVENTION

This invention relates to a device for preparing hot-melt adhesives for subsequent application to a substrate.

BACKGROUND OF THE INVENTION

The first function of preparation devices of this type is to heat the hot-melt adhesive, which is in the form of, for example, a granulate or the like. Heating converts the adhesive into a viscous state, so that it can be applied in the form of, for example, a bead, to a substrate or the like, where it can perform its adhesive function. After the hot-melt adhesive has thus been liquified, it is conveyed by a pump which forms part of the preparation device, possibly also by a valve present there, to one or more hoses connected to the preparation device. The hot-melt adhesive can then be routed via the hoses to a separate applicator device, such as an automatic, or semiautomatic, stationary or hand-held applicator gun.

These preparation devices for hot-melt adhesives must be cleaned, maintained, and/or possibly repaired from time to time. Therefore, in the design of preparation devices of this type, the designer is faced not only with the job of meeting the normal performance and economic specifications but also with the problem of fulfilling two additional, contradictory requirements. The first of these requirements is that the preparation device must be designed to be as compact as possible, especially in the case of mobile preparation devices. The second requirement is that the design of the device must at the same time make it convenient for performing the work mentioned above, i.e. cleaning, maintenance and repair.

With respect to the latter requirement, it is especially important that the maintenance and cleaning personnel be able to gain access to the structural and functional assemblies of the preparation device for maintenance, cleaning or repairs, and that this be done with minimum disassembly. In the preparation devices known in practice, this requirement has led to the situation that the individual structural and functional assemblies are relatively far apart, so that after the removal of the panels in the area of the structural and functional assembly to be cleaned or maintained, the cleaning and maintenance personnel are able to access these components without the need to also remove additional panels in other areas of the preparation device. A design of this type means that it is necessary to provide several individual housings for a single preparation device, which leads to the need for a correspondingly large number of panels. However, a design such as this is not compatible with the requirement stated above for a compact preparation device.

In the case of the known preparation devices, either the panels of the housing are removed completely from the preparation device, or they are hingedly connected to the rest of the housing. In the former case, a great deal of extra work is created because each time a maintenance, repair, and/or cleaning job is to be carried out, the panels must be detached from the housing and set aside. Upon completion of the work, the panels must be taken up again and reattached to the housing. In the latter case, the amount of work involved in fabricating the device is increased, because extra hardware such as hinges, etc., must also be provided. In the case of repair, cleaning or maintenance jobs which involve the entire preparation device, furthermore, a great deal of time is needed to remove all of the panelling from the preparation device.

It is an object of the present invention to create a preparation device for hot-melt adhesives which simultaneously improves upon the desirable features of compactness in design and ease in performing periodic jobs such as maintenance, repair and/or cleaning.

SUMMARY OF THE INVENTION

The present invention achieves the above-stated objective via a compact housing for a hot melt adhesive preparation device, wherein the housing includes a housing section which can be moved in the horizontal plane, with a single motion, to at least partially expose one or more otherwise enclosed operational components to facilitate cleaning, repair and/or maintenance. Depending on the design of the housing section, access to the components, or structural and functional assemblies, can be achieved from several sides, so that there is no interference from any of the other structural and functional assemblies.

This movable housing section makes it possible to create a preparation device of extremely compact design. In addition, the amount of manual handling required is also considerably reduced because the preparation device of this invention eliminates the need to loosen and then set aside individual covering panels, as with prior preparation devices. Therefore, this invention offers the designer of a preparation device the ability to make the device as compact as possible, but without thereby causing interference with the maintenance, cleaning, and/or repair work which must be carried out from time to time.

The movable section of the housing can make either a pivoting or a linear motion in the horizontal plane via an appropriate motion-guiding device. The motion-guiding device can be designed in many different ways. In the case of a pivoting motion in the horizontal plane, the motion-guiding device can be, for example, an essentially vertical hinge. It is also possible for the horizontally movable housing section to execute a combination of a linear and a pivoting motion.

As a further possibility, and according to a preferred embodiment of the invention, the motion-guiding device may be a drawer guide. In this case, the motion-guiding device can comprise rails on a support base and guide elements mounted on the housing section, (or vice versa) which are guided by the rails. It is especially advantageous in this case for the components of the motion-guiding device to allow the movable housing section to be moved relatively easily.

An especially compact design of the preparation device can be achieved by mounting at least one of the structural and functional assemblies of the preparation device in the movable housing section. This can be a structural and functional assembly of the preparation device which seldom if ever requires maintenance or cleaning, such as, for example, the electrical control unit of the preparation device. A design such as this then makes it possible for the structural and functional assemblies of the preparation device to be mounted on top of each other, in stacked relationship. For example, the electrical control unit can be mounted above the electrical drive for the pump of the preparation device. By moving aside the housing section holding this structural and functional assembly, possibly together with any additional panels which may have been provided to encase the structural and functional assembly mounted under or over the movable housing section, the structural and functional assembly concealed by the movable housing section can be exposed, to allow it to be maintained without difficulty during the operation of the preparation device.

As a result, during a maintenance, repair and/or cleaning operation, it is possible to inspect the functional capacity of the individual structural and functional assemblies of the preparation device in spite of the fact that the housing section holding the electrical control unit has been moved to the side. Also, the electrical cables connecting the movable housing section to the structural and functional assemblies are preferably long enough that the electrical connections between the control unit and each of the other structural and functional assemblies remains preserved even after the movable housing section has been moved into the open position.

The housing itself can also assume many different forms. If, for example, a structural and functional assembly, especially the electrical control unit of the preparation device, is mounted in the movable housing section, then the other structural and functional assemblies can be mounted not only next to the movable housing section but also under it, as already explained above. In particular, a pump drive unit and possibly even the pump itself can be installed under the movable housing section. In this case, the stationary housing section can have the shape of an "L" when seen from the side, and the horizontal shank of the L-shaped, stationary housing section, i.e. the base, can serve, for example, to encase the pump drive unit and possibly the pump, whereas the vertical shank of the L-shaped, stationary housing section can serve to encase a supply tank for the hot-melt adhesive, a heating device, and possibly a valve which may have been provided. In contrast, the movable housing section can have an essentially rectangular shape when seen from the side. When the movable housing section is in its closed position, the entire housing will then have an essentially rectangular shape. It is also possible for both the stationary and the movable housing sections of the housing to be rectangular when seen from the side.

So that the preparation device according to the invention can be used at different locations, it is also possible to provide the base with wheels or the like.

These and other features of the invention will be more readily understood in view of the following detailed description and the drawings.

DETAILED DESCRIPTION OF THE INVENTION

Figure 1:
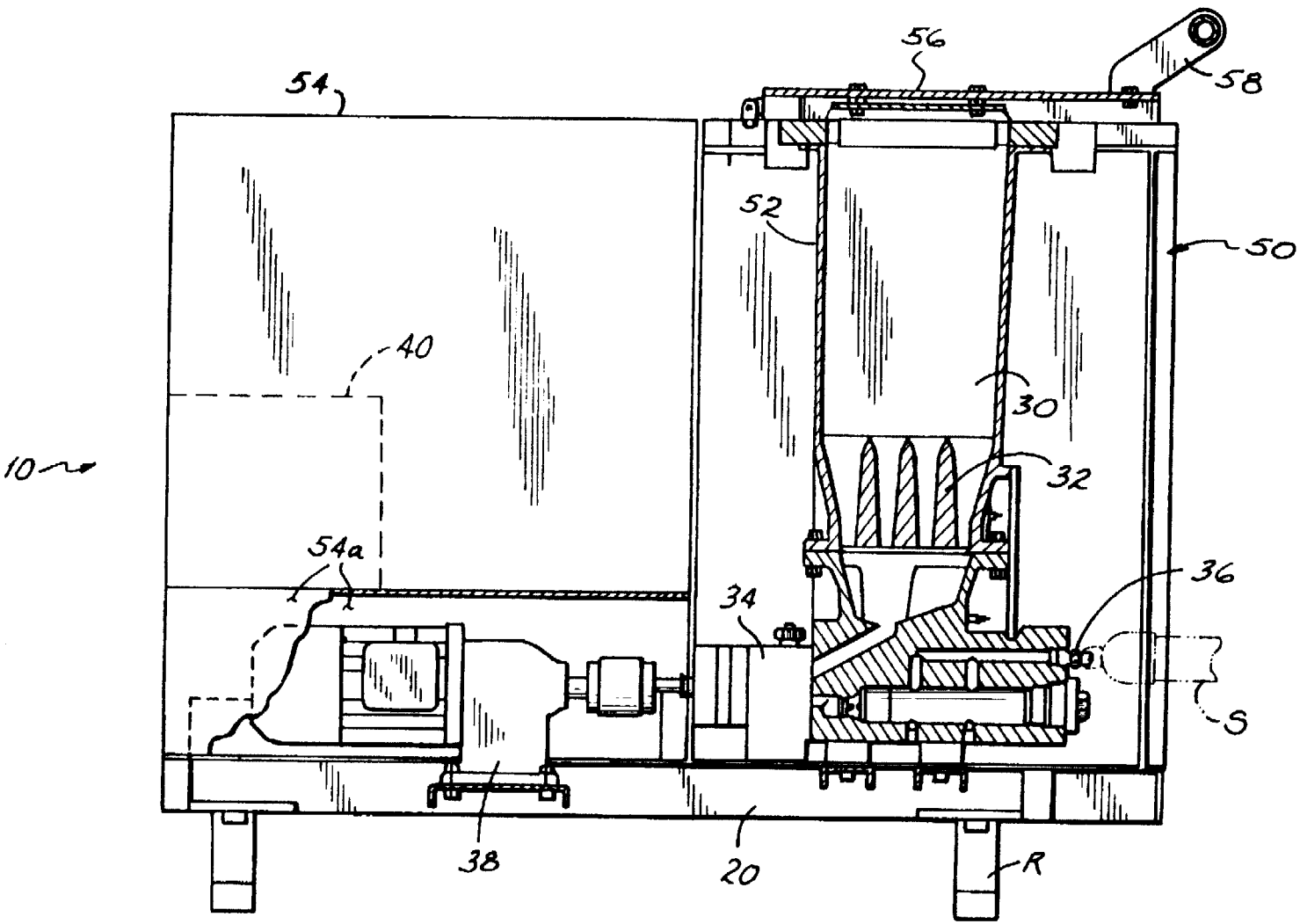
FIG. 1 shows a partially cutaway side view of a preparation device according to a preferred embodiment of the invention, with a movable housing section in a closed position.
Figure 2:
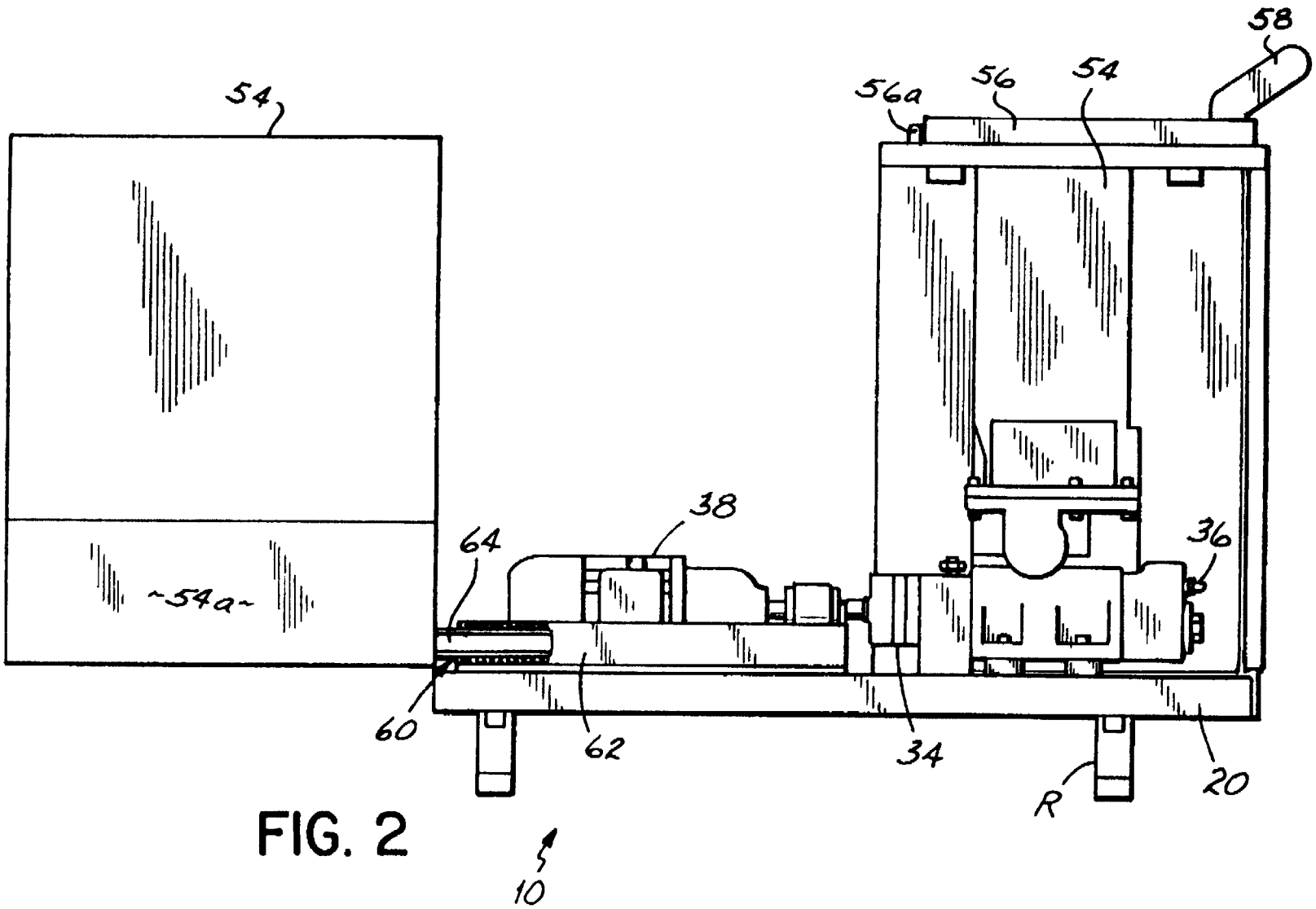
FIG. 2 show a shows side view of the preparation device of FIG. 1, with the movable housing section moved to an open position.

A preparation device 10 according to a preferred embodiment of the invention is shown in FIGS. 1 and 2, with a base 20, structural and functional assemblies 30–40, a housing 50, and a motion-guiding device 60 (FIG. 2). In effect, the base 0 serves as the bottom of the housing.

The operational components, or structural and functional assemblies 30–40, include a supply tank 30, which holds the hot-melt adhesive, which is in the form of, for example, a granulate. At the bottom of tank 30, a heating device 32 is provided, which is designed as a set of essentially vertically oriented, heatable ribs. The ribs serve to liquify the hot-melt adhesive granulate loaded into the tank 30. The hot-melt adhesive thus liquified is pumped by a pump 34 and a valve 36 to one or more hoses S, indicated in FIG. 1 by phantom lines. The pump 34 is driven by an electric motor 38, which is also mounted on the base 20. The entire preparation device 10 is controlled by a control unit 40, i.e. another one of the operational components.

Housing 50 comprises a stationary housing section 52, which, seen from the side, is essentially rectangular, and a movable housing section 54, which, seen from the side, is also rectangular. The stationary housing section 52 encloses the supply tank 30, the heating device 32, the pump 34, and the valve 36 of preparation device 10. The movable housing section 54, however, holds the electrical control unit 40. Underneath the control unit 40, an electric motor 38 is located. As shown best in FIG. 2, panels **54*a* are provided at the bottom end of the movable housing section 54. When movable housing section 54 is in the closed position, these panels enclose electric motor 38** in such a way that it is no longer accessible from the outside.

The movable housing section 54 is connected to the base 20 and thus to stationary housing section 52 by a motion-guiding device 60. According to the preferred embodiment shown in the Figures, the motion-guiding device 60 comprises essentially horizontal rails 62 which are attached to the base 20, which cooperatively engage guide elements 64 secured to the movable housing section 54. The motion-guiding device 60 enables the movable housing section 54 to slide back and forth in a horizontal plane between a closed housing position shown in FIG. 1 and an open housing position shown in FIG. 2.

Stationary housing section 52 also has at its upper end a cover 56 which pivots around a horizontal axis **56*a*. This cover makes it possible to load the hot-melt adhesive granulate into the supply tank 30 (see FIG. 2). A handle 58 is attached to the stationary housing section 52. The housing 50 components can be made either of sheet metal or of a plastic material. Base 20 can be built up of sectional or hollow-profile components and possibly provided with a continuous platform. Also, the preparation device 10 may be equipped on an external surface thereof, both on stationary and movable housing sections 52, 54, with elements for controlling operation of the preparation device 10. Finally, base 20** can be provided with supporting wheels (R) on the bottom thereof.

In use, to carry out maintenance, cleaning or repair work, for example, the movable housing section 54 is moved from the closed housing position shown in FIG. 1 to the open housing position shown in FIG. 2, via the motion-guiding device 60. As a result, the electric motor 62, the pump 34, the valve 36, any couplings between the electric motor 38 and the pump 34, and the supply tank 30 and its corresponding heater 32 are made readily accessible for the performance of the maintenance, repair and/or cleaning work. Upon completion of the work, the movable housing section 54 is moved back from the open position Shown in FIG. 2 to the closed position shown in FIG. 1.

It is to be understood that, although not shown in FIGS. 1 and 2 for clarity reasons, cables are used to interconnect each of the electric motor 38, the heating device 32, and the pump 36, etc. to the control unit 40. The connections are of such a length that movement of the housing section (54) with control unit (40) therein will not result in any electrical disconnections for the preparation device (10).

While a preferred embodiment of the invention has been described, it is not the intention of applicant to restrict or in any way limit the scope of the appended claims to such detail. Additional advantages and modifications will be readily apparent to those skilled in the art. The invention in its broader aspects is therefore not limited to the specific details, representative apparatus and method shown and described. Accordingly, departures may be made from such details without departing from the spirit or scope of applicant's general inventive concept.

We claim:

1. A preparation device for hot-melt adhesive for subsequent application of the hot-melt adhesive to a substrate, comprising:

at least two operational components (30–40) mounted on a common base (20);

a housing (50) attached to the base (20) and enclosing the operational components (30–40), the housing (50) including a movable housing section (54) movable back and forth in a horizontal plane with respect to at least one of the base (20) and the housing (50), between a closed housing position wherein the operational components are concealed and an open housing position wherein at least one of the operational components is at least partially exposed (30–40); and a motion-guiding device (60) operatively connected to the movable housing section (54) and to one of the base (20) and the rest of the housing 50, thereby to permit movement of the movable housing section (54).

2. The preparation device of claim 1 wherein the motion-guiding device (60) causes the movable housing section (54) to move linearly.

3. The preparation device of claim 1 wherein the motion-guiding device (60) includes a drawer guide.

4. The preparation device of claim 3 and further comprising: rails (62) mounted on the base (20); and guide elements (64) mounted on the movable housing section (54), the guide elements (64) guided by the rails (62), thereby defining the drawer guide.

5. The preparation device of claim 1 wherein the movable housing section (54) encloses at least one of the operational components (30–40).

6. The preparation device of claim 5 wherein the movable housing section (54) encloses an electrical control unit (40), which operatively connects to and controls operation of other operational components.

7. The preparation device of claim 6 wherein the control unit (40) remains operatively connected to the other operational components even after the movable housing section (54) has been moved into the open position.

8. The preparation device of claim 1 wherein the housing (50) further includes a stationary housing section (52), and the base (20) and the stationary housing section (52) are designed in the shape of an "L", as seen in vertical cross section, wherein the movable housing section (54), when in the closed position, together with the stationary housing section (52) and the base (20), form a rectangular housing (50).

9. The preparation device of claim 1 and further comprising:

a plurality of wheels (R) supporting the base (20).

* * * * *